US006696630B2

(12) United States Patent
Gatzen

(10) Patent No.: US 6,696,630 B2
(45) Date of Patent: Feb. 24, 2004

(54) DAMPING DEVICE FOR PERCUSSION INSTRUMENTS

(75) Inventor: Robert A. Gatzen, Newington, CT (US)

(73) Assignee: J. D'Addario & Co., Inc., Farmingdale, NY (US)

( * ) Notice: Subject to any disclaimer, the term of this patent is extended or adjusted under 35 U.S.C. 154(b) by 0 days.

(21) Appl. No.: 10/174,723

(22) Filed: Jun. 19, 2002

(65) Prior Publication Data

US 2003/0233928 A1 Dec. 25, 2003

(51) Int. Cl.[7] ..... G10D 13/02
(52) U.S. Cl. ..... 84/411 M; 84/411 R; 84/273
(58) Field of Search ..... 84/411 M, 411 R, 84/273, 287, 288

(56) References Cited

U.S. PATENT DOCUMENTS

| | | | | | |
|---|---|---|---|---|---|
| 2,078,004 | A | * | 4/1937 | Lebow | 84/411 R |
| 4,325,281 | A | | 4/1982 | Hardy | 84/411 M |
| 4,567,807 | A | | 2/1986 | Robinson | 84/411 M |
| 4,671,158 | A | * | 6/1987 | Saputo | 84/411 M |
| 4,899,635 | A | * | 2/1990 | Santangelo | 84/411 M |
| 5,159,139 | A | | 10/1992 | Beals et al. | 84/414 |
| 5,892,169 | A | | 4/1999 | Shapiro | 84/411 M |
| 6,291,754 | B1 | | 9/2001 | Gatzen et al. | 84/411 M |

* cited by examiner

*Primary Examiner*—Shih-Yung Hsieh
(74) *Attorney, Agent, or Firm*—Gerald T. Bodner

(57) ABSTRACT

A vibration damping device for a drum includes a drumhead contact adapted to be releasably fixed to a drumhead of the drum and a strap releasably connected between the contact and a drumhead hold-down hoop for forming a drum vibration bridge between the drumhead and the hold-down hoop. The strap has a hoop attachment end and a contact attachment end opposite the hoop attachment end. The hoop attachment end is adapted to be fixed to the drumhead hold-down hoop of the drum, while the contact attachment end is adapted to be releasably connected to the contact.

17 Claims, 7 Drawing Sheets

DAMPING DEVICE FOR PERCUSSION INSTRUMENTS

FIELD OF THE INVENTION

The present invention relates generally to devices for adjusting the sound of percussion instruments, and more particularly to an adjustable damping device externally mountable on a drum for transferring drumhead vibrations to the drumhead hold-down hoop of the drum.

BACKGROUND OF THE INVENTION

Devices for adjusting or tuning the sound produced by a percussion instrument are well known in the art. In particular, there have been many attempts to create efficient damping systems for the drum set, specifically, the tom-toms and snare drum components. To date, there is not a standard damping method for drums that is recognized in the field.

Drum overtones are higher pitched frequencies usually produced from the outside edge (perimeter) of the drumhead. These frequencies represent the most distant pitch relationships from the fundamental pitch produced by the drumhead. They produce a "metallic" type sound that must be properly balanced to produce a good drum sound. This is called, "overtone suppression". When overtones are out of balance, or totally eliminated, the overall tonal quality of the drum is severely diminished.

Previous damping devices for overtone suppression have suffered problems ranging from undesirable effects on the sound and feel of the drum to inconvenience of use. For example, conventional devices are often too complicated and bulky. The first dampeners created were the spring and pad type. This mechanism was simply a metal spring material with a round pad (typically felt material) attached at one end. The other end of the spring is attached to the drum. At first, these dampeners were attached to the hold-down hoop on the outside of the drum shell. In the 1960's, drum manufacturers began attaching the dampener inside the drum shell in an effort to hide the dampener and to make it more convenient to use and difficult to lose. The problem with this device is that it placed constant pressure upward against the bottom of the drumhead surface, resulting in an undesirable method for damping the drum sound. Regardless of the placement the spring/pad dampener, the problem is that it exerts constant pressure against the head, which affects the head movement even before it is struck.

Two reasonably successful damping devices that have been developed and marketed are the Zero-Ring™, created by Noble & Cooley Drum Company in the 1980's, and the Moon-Gel™, created by Thomas Rogers in the 1990's. The Zero-Ring™ device is a polyester ring that sits along the perimeter of the drumhead and is held down by gravity and static charge generated between the head and the ring. However, this device offers no adjustment in the level of damping and, thus, totally suppresses overtones. Also, the ring can easily become bent or distorted, thereby preventing proper adhesion to the head surface. The Moon-Gel™ dampener is a high-density piece of flexible, synthetic material that can be placed anywhere on the head surface and is held down by the tacky nature of the material. Even though this method provides adjustability, there are inherent problems in the fact that overtone suppression build-up is radically affected by placing the extremely dense material in a small area on the surface of the drumhead. Also, the material requires regular cleaning care to maintain adhesion.

Today, there is a broad range of drumheads available and designed to attain any desired drum tone. The problem, however, is that changing drumheads to attain a desired drum tone is a tedious, time consuming chore, not to mention the expense of changing a full set of drumheads. This places limitations on the drummer in that it is often necessary to change the drum sound on the fly depending on the musical style and performance environment. This is especially true in the recording studio environment.

OBJECTS AND SUMMARY OF THE INVENTION

It is an object of the present invention to provide a simple, low-cost damping device that is easily externally mounted to a drum for providing a damping effect to the drumhead.

It is another object of the present invention to provide a durable, low maintenance damping system that is highly adjustable to produce almost any desired sound damping effect to the drumhead.

These and other objects are achieved by the externally mounted damping device of the present invention. The damping device of the present invention generally includes a drumhead contact adapted to be adhesively secured (optionally, releasably) to a drumhead of a percussion instrument (such as a drum), and a strap or other elongate member releasably connected between the contact and an exposed surface of the percussion instrument, such as the side of the drum, but most preferably, the drumhead hold-down hoop (commonly referred to as a "counterhoop") for forming a drum vibration bridge between the drumhead and the exposed surface, e.g., the hold-down hoop. The elongate member (e.g., the strap) has a hoop attachment end and a contact attachment end opposite the hoop attachment end. The hoop attachment end is adapted to be fixed to the drumhead hold-down hoop (or other exposed surface) of the drum, while the contact attachment end is adapted to be releasably connected to the drumhead contact.

In a preferred embodiment, the drumhead contact includes a pressure-sensitive or other type adhesive layer for releasably securing the contact to the drumhead. Additionally, the strap (or other elongate member) is made of a fabric material having one of a hook and loop fastening surface at the contact attachment end, and the contact includes the other of the hook and loop fastening surface. The fastening surface of the strap engages the fastening surface of the contact for providing the releasable connection between the contact and the strap. The strap further preferably includes a patch fixed thereto and having one of a hook and loop fastening surface. The fastening surface of the strap contact attachment end engages the fastening surface of the patch for securing the strap to itself when not in use.

Preferably, the device includes a strap attachment pad having a pressure-sensitive adhesive layer for releasably (or substantially permanently) fixing the strap attachment pad to the drumhead hold-down hoop of the drum, whereby the hoop attachment end of the strap is releasably connected to the pad. Again, the strap attachment pad includes one of a hook and loop fastening surface, which engages with the fastening surface of the hoop attachment end of the strap for providing releasable connection between the strap and the strap attachment pad.

The elongate member can take different shapes depending on the desired damping effect. In one embodiment, the member is made of a fabric material and includes at least one neck portion defining a teardrop-shaped contact attachment end. In another embodiment, the elongate member includes a hoop attachment foot defining the hoop attachment end, a contact attachment foot defining the contact attachment end and a wire connecting the hoop attachment foot to the contact attachment foot. Preferably, the contact attachment foot is made of a fabric material having one of a hook and loop fastening surface and the contact includes the other of the hook and loop fastening surface. The fastening surface of the contact attachment foot engages the fastening surface of the contact for providing the releasable connection between the contact and the elongate member. The hoop attachment foot can also include one of a hook and loop fastening surface for engaging with a fastening surface provided on a elongate member attachment pad.

Alternatively, the contact attachment foot and the hoop attachment foot can be formed as plastic fittings including an ear projection defining a hole, whereby the wire member is releasably connected between the ear projections of the fittings. The fittings can be provided with one of a hook and loop fastening surface, for engaging with a respective contact and elongate member attachment pad, or the fittings can each have a pressure-sensitive adhesive layer for releasably fixing the fittings directly to the respective drumhead and drumhead hold-down hoop.

The present invention further involves a method for damping the vibration of a drumhead. The method includes the steps of attaching one end of a strap (or other elongate member) to an external surface of the drumhead and attaching an opposite end of the strap to any area on the drum but preferably the drumhead hold-down hoop, whereby the strap forms a drum vibration bridge between the drumhead and the drumhead hold-down hoop.

These and other objects, features and advantages of this invention will become apparent from the following detailed description of illustrative embodiments thereof, which is to be read in connection with the accompanying drawings.

DETAILED DESCRIPTION OF THE PREFERRED EMBODIMENTS

Figure 1:
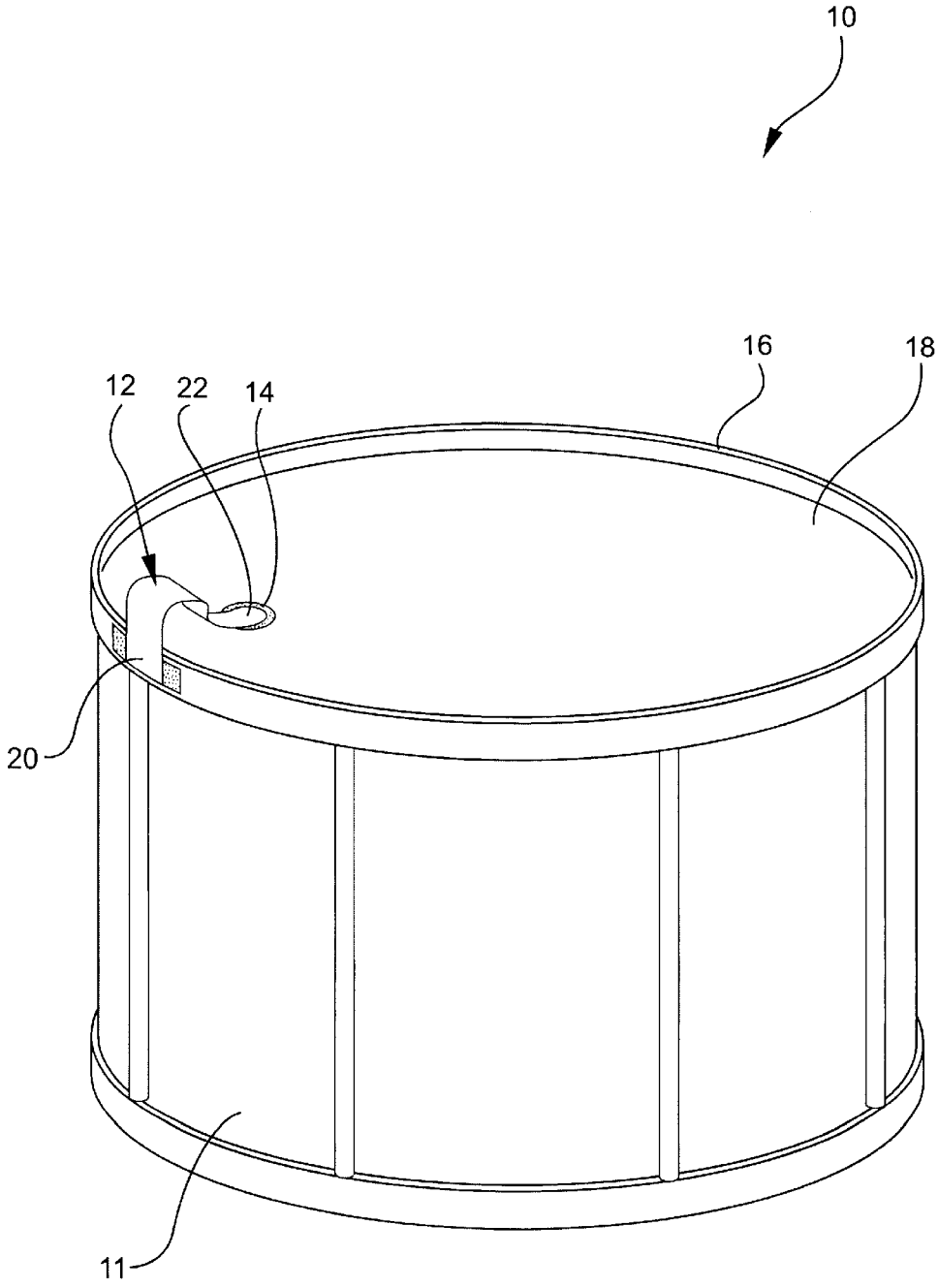
FIG. 1 is a top perspective view of a preferred embodiment of the damping device formed in accordance with the present invention mounted to a drum for damping.
Figure 2:
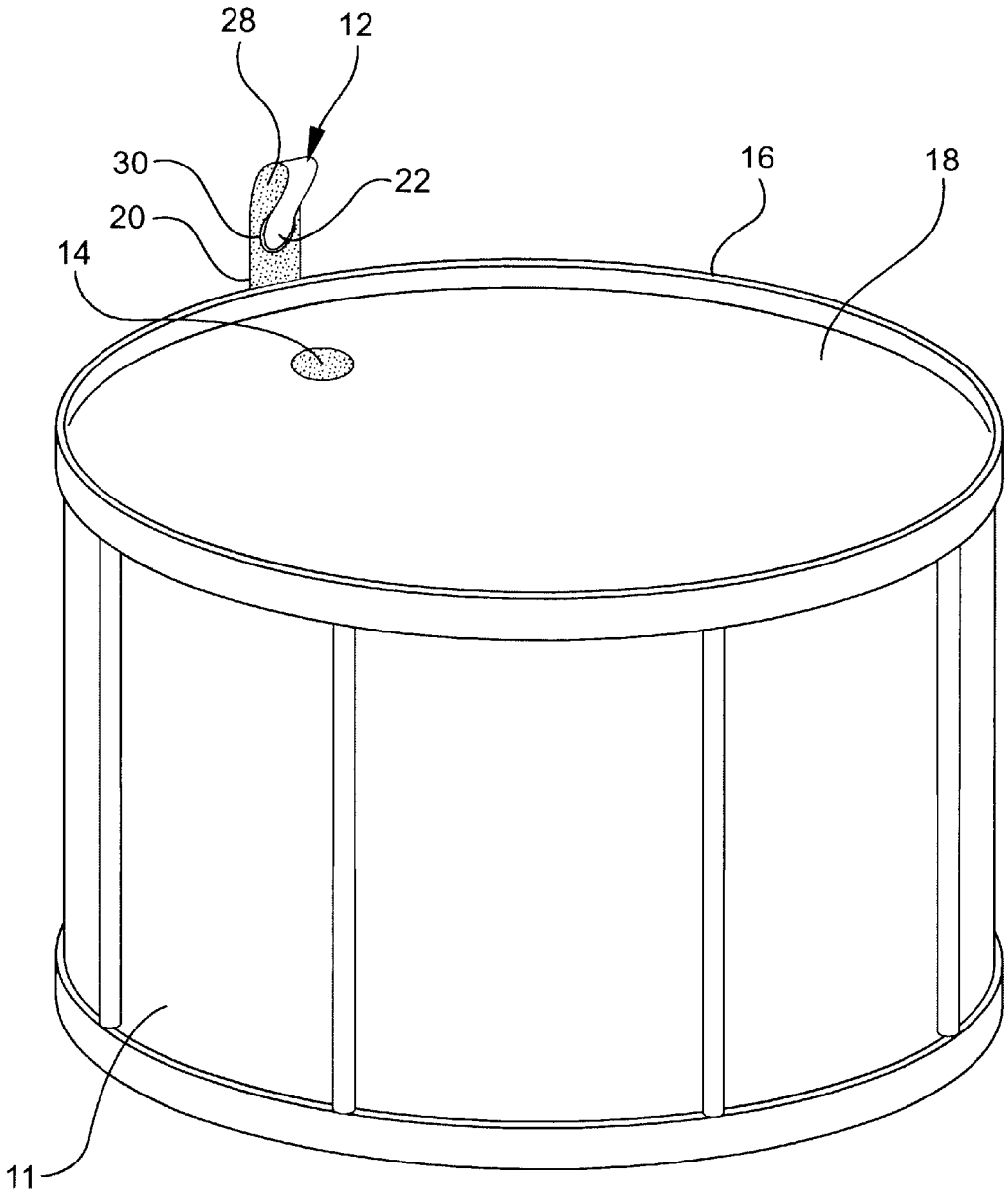
FIG. 2 is a top perspective view of the damping device of FIG. 1 shown in its non-damping position.

Referring first to FIGS. 1 and 2, a damping device 10, formed in accordance with the present invention, is shown attached to a drum 11. The damping device 10 generally includes a flexible strap 12 and at least one drumhead contact 14. As used herein, the term "strap" is meant to encompass any elongate member, including cross-sectionally flat, rectangular or round members formed of wire, rubber, synthetic and non-synthetic fabrics, Velcro™ material, elastic and resilient materials and any other material which may act as a bridge to carry vibrations from the drumhead to another portion of the percussion instrument. The strap 12 is preferably attached at one end to the drumhead hold-down hoop 16, although it is envisioned to be attached to the side of the drum or other exposed surface. The drumhead contact 14 is releasably affixed to the external surface of the drumhead 18 near its outer perimeter and adjacent the strap 12. In use, the opposite end of the strap 12 is releasably connected to the drumhead contact 14 for damping the drum, as shown in FIG. 1. When damping is not desired, the strap 12 is disconnected from the drumhead contact 14 and can be conveniently secured on the hold-down hoop 16, as shown in FIG. 2. A quick hand movement allows the drummer to engage and disengage the damping device 10 from the drumhead, at will.

Thus, when the strap 12 is connected to the drumhead contact 14, it forms a bridge between the hold-down hoop 16 and the drumhead 18. The drumhead 18 is, of course, a vibrating element, and when the strap 12 is attached to the drumhead, it also becomes a vibration element, and provides a wide range of damping effects. The bridge formed by the strap 12 inhibits or slows drumhead vibration, which in turn shortens the sustain of the drum sound, resulting in a more focused sound. In other words, the tension in the bridge provides a vibration path or conduit between the drumhead 18 and the hold-down hoop 16. Because the drumhead contact 14 is attached to the drumhead 18 near its perimeter, the overtones or range of frequencies created in this area of the vibrating drumhead are slowed. When it comes to overtone suppression, there is a very important and unique advantage to this bridge-type dampener. The harder the drumhead 18 is struck, the more the bridge allows overtones to ring out. This is a crucial factor to achieving a balanced tone through all the dynamic ranges.

Figure 3:
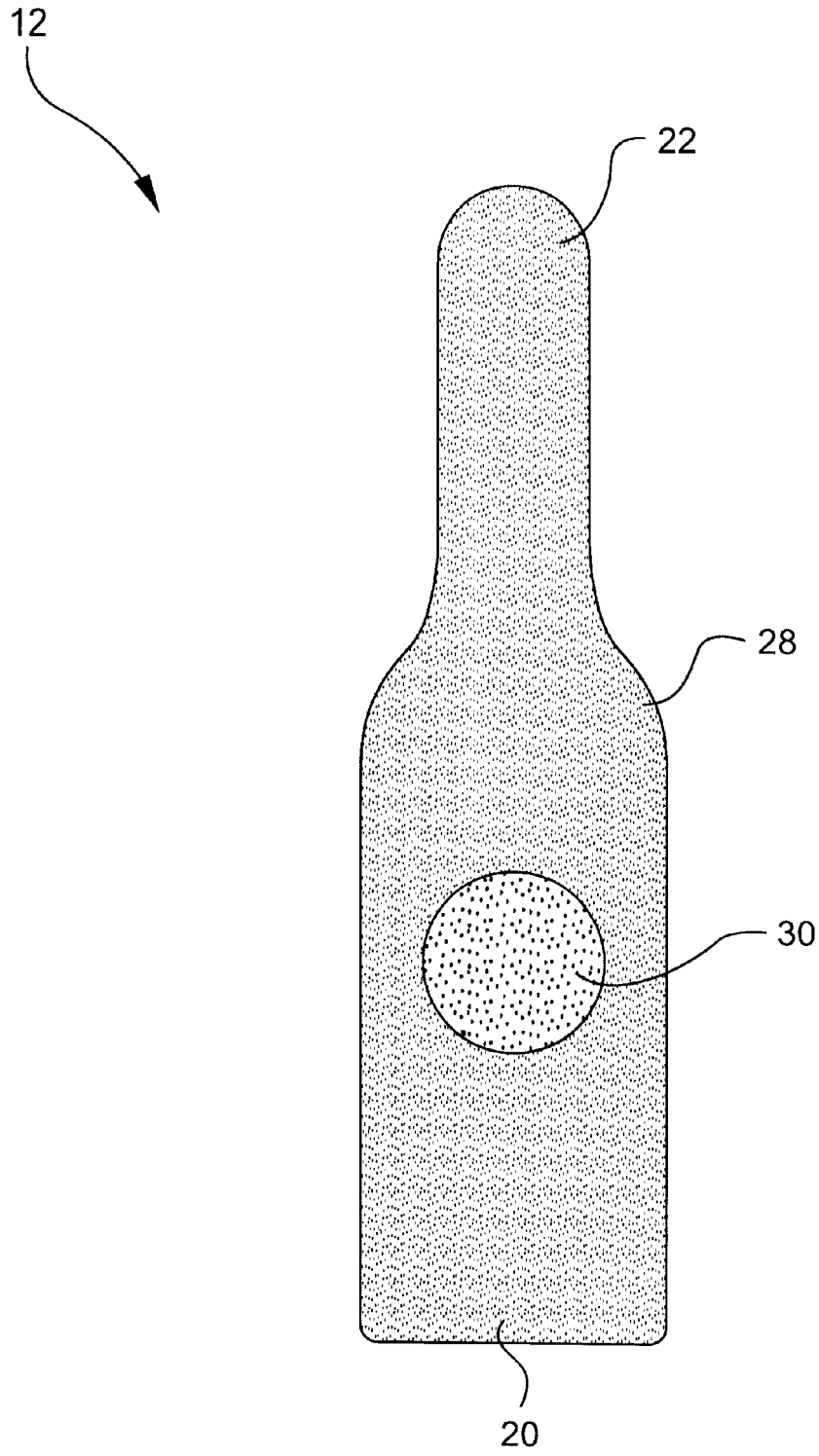
FIG. 3 is a top plan view of the damping device strap of the present invention shown in FIGS. 1 and 2.

Referring additionally to FIG. 3, the strap 12 preferably is made from a thin, flexible, yet durable, material. Preferably, the strap 12 is made from a strong synthetic fabric material having a thickness of between about 1/16 inch and about 1/4 inch. Of course, thicker straps can be utilized to stiffen the strap and thereby increase the damping effect, as desired. The strap 12 includes a hoop attachment end 20 and a contact attachment end 22 opposite the hoop attachment end. The length and width of the strap can vary depending on the desired damping effect. However, a preferred range for the length of the strap 12 is between about 2 and about 6 inches, and the preferred range for the width of the strap is between about 3/8 inches and about 2 inches. Preferably, the strap 12 is wider at its hoop attachment end 20 then at its drumhead attachment end 22 to provide a larger attachment surface to the drumhead hold-down hoop 16.

Figure 4:
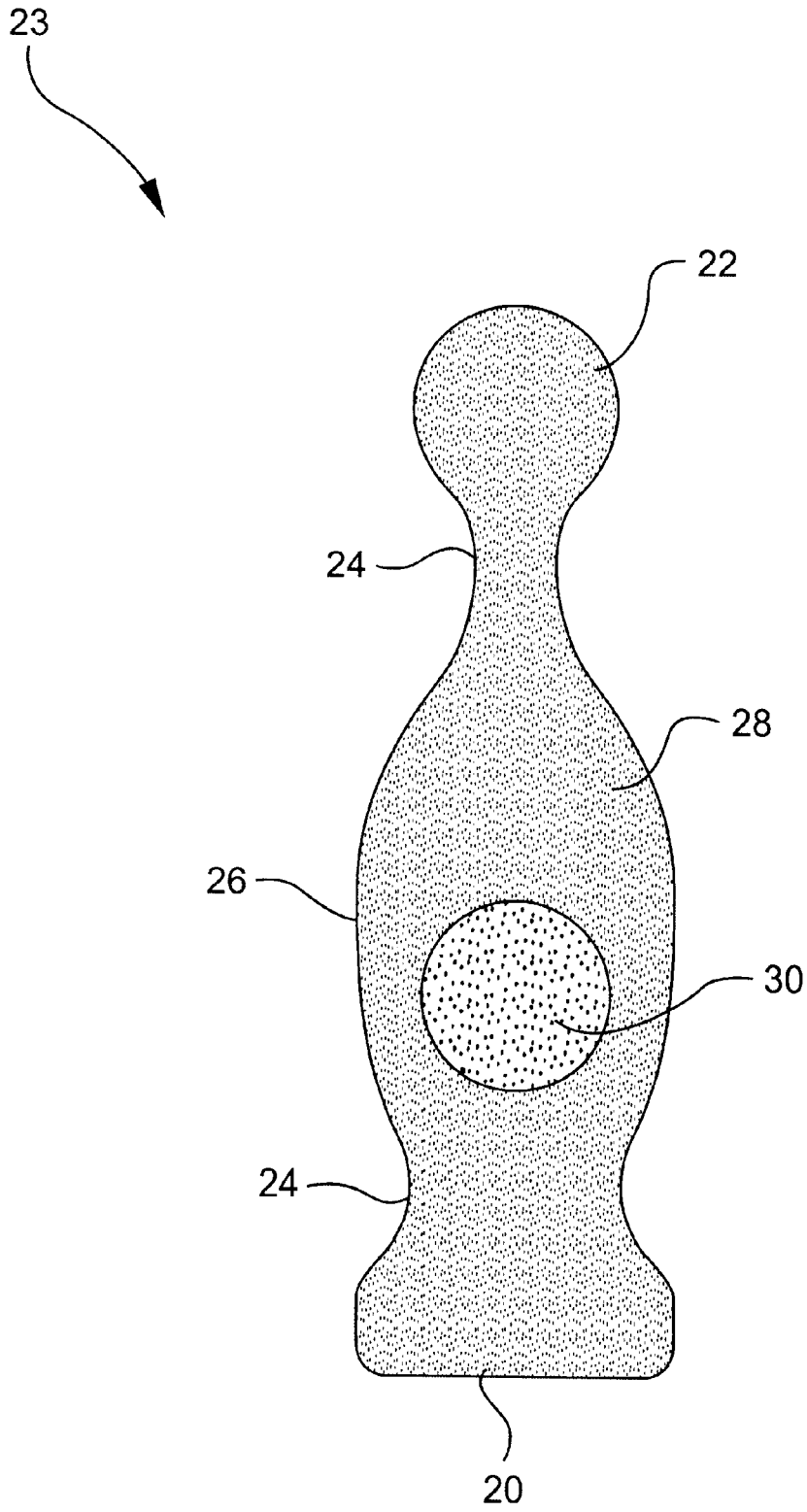
FIG. 4 is a top plan view of a second embodiment of the damping device strap of the present invention.

The width of the strap 12 can vary along the strap length depending on the desired damping effect to be achieved. FIG. 4 shows a strap 23 having two neck portions 24 between the hoop attachment end 20 and the disk attachment end 22, thereby defining a transversely enlarged middle portion 26 and a teardrop shaped contact attachment end 22. It is envisioned that such narrower straps would typically be used on smaller drums.

The contact attachment end 22 of the strap 12 (FIG. 3) or strap 23 (FIG. 4) includes a means for releasably mechanically connecting the strap to the drumhead contact 14. In a preferred embodiment, at least one of the major faces of the strap 12 or 23 is provided with one of a hook and loop fastening surface. The inner face (i.e., the side facing the drumhead) of the straps 12 and 23 shown in FIGS. 1–4 is preferably provided with a Velcro™ loop material surface 28. Providing the Velcro™ loop material on the straps 12 and 23, as opposed to the hook material, permits greater flexibility of the strap.

The straps 12 and 23 further preferably include a patch 30 of double-sided Velcro™ hook material fixed generally in the center of the strap on its inner face 22. The hook material patch 30 removably adheres to the loop material of the strap and, therefore, may be removed and repositioned on the strap, if desired, but it may also be formed from single-sided hook material that is sewn to the strap 12 or 23, or adhesively fixed to the strap, so that the hook material side is exposed. The hook material patch 30 provides an attachment surface for the contact attachment end 22 of the straps 12 and 23 when the damping device 10 is not in use, as shown in FIG. 2. Thus, the strap 12 and 23 can be folded in on itself and secured out of the way of the drumhead 18. Of course, it is envisioned that means other than patch 30 for releasably securing the contact attachment end 22 to another portion of the stray 12 may be used. For example, the middle portion of strap 12 may have secured to it a male or female snap fitting (not shown) positioned near the contact attachment end 22 of the strap, to allow the strap to fold in on itself when not in use. The strap 30 itself may be resilient and/or have inherent tension, such as a U-shaped resilient or spring-biased plastic member formed by conjoined legs (not shown). One leg may be affixed to the hold-down hoop or other drum surface, while the other leg may be urged to engage the drumhead contact 14 against the resiliency or bias of the legs to remain close together.

Figure 5:
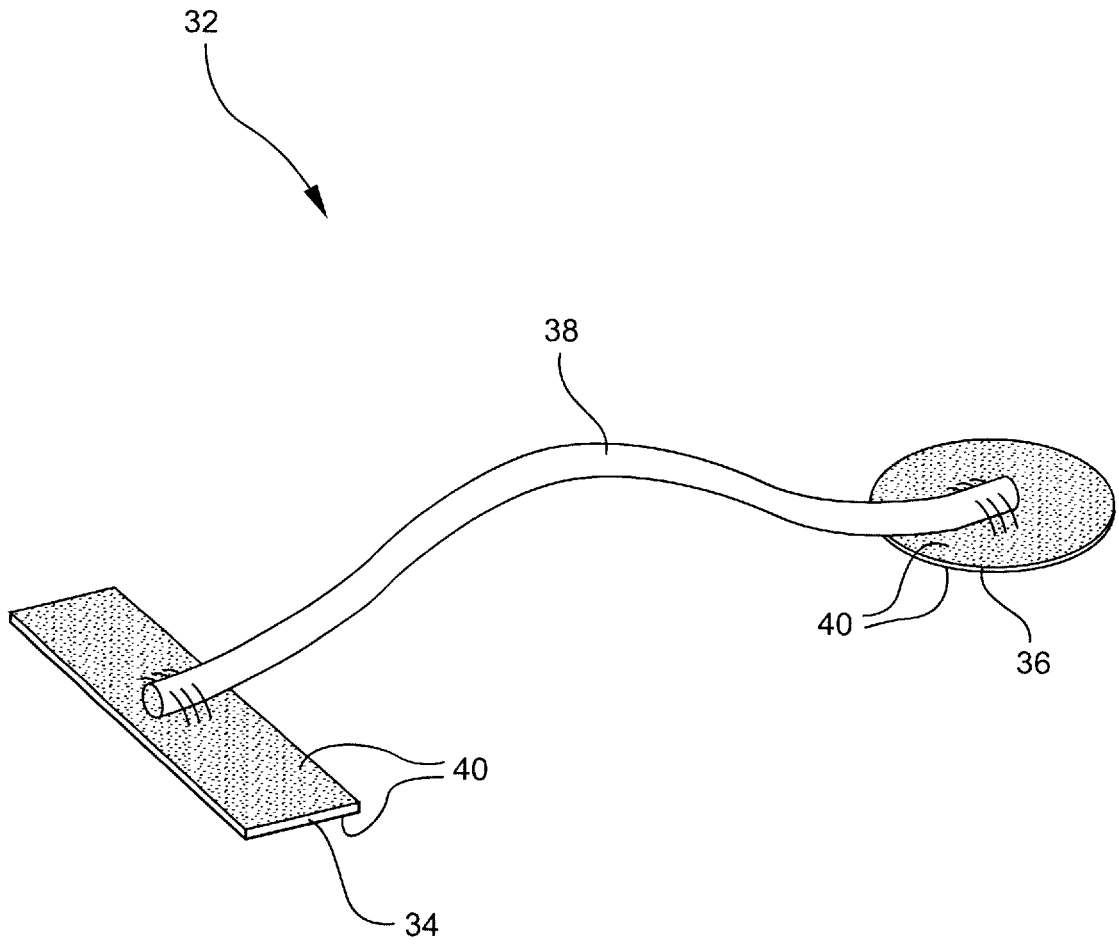
FIG. 5 is a top perspective view of a third embodiment of the damping device strap of the present invention.

FIG. 5 shows another alternative embodiment of a strap 32. The strap 32 shown in FIG. 5 includes a hoop attachment foot 34, a drumhead contact attachment foot 36, and a flexible wire 38 interconnecting the hoop attachment foot 34 and the drumhead contact attachment foot 36. The wire 38 can be any suitable material having some degree of stiffness sufficient to transfer vibrations from the drumhead 18 to the hold-down hoop 16 and, therefore, act as a bridge. Piano wire, wound music string or spring wire may be used for wire 38. The hoop attachment foot 34 and the contact attachment foot 36 are preferably thin fabric materials having Velcro™ loop fastening surfaces 40. The wire 38 is fixed to the hoop attachment foot 34 and to the contact attachment foot 36 by any suitable method, such as by sewing or by gluing. Again, the length and gauge of the wire 38 can vary depending on the desired damping effect and the size of the drum. Thicker or stiffer wires will generally increase the damping effect on the drumhead 18.

Figure 6:
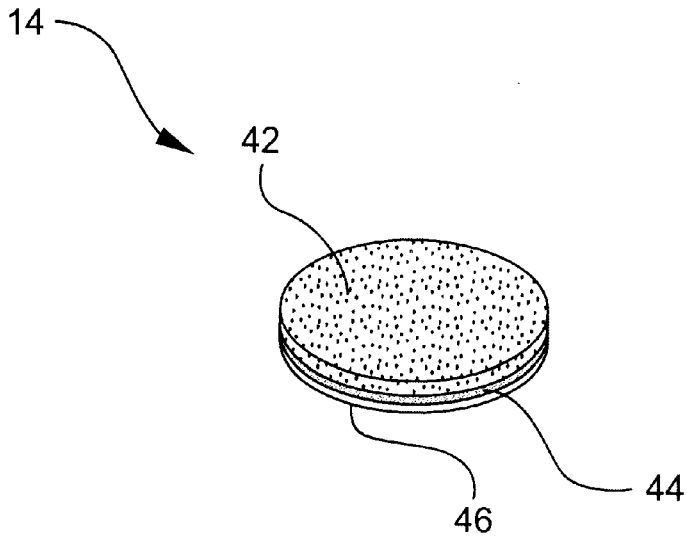
FIG. 6 is a perspective view of the adhesive drumhead contact for the damping devices of the present invention shown in FIGS. 1–5.

FIG. 6 shows the drumhead contact 14 which, in use, is releasably fixed to the drumhead 18. The contact 14 can be any means of providing a releasable mechanical connection between the fabric strap 12 or 23 or wire strap 32 and the drumhead 18. In conjunction with the contact attachment end of the strap, such means can include, for example, a piece of double-sided adhesive tape, a snap-on button, a hooking or latching device, a magnetic contact, and others. In accordance with the preferred embodiment of the strap, the drumhead contact 14 is in the form of a thin, circular disk having a thin, Velcro™ hook material layer 42 and a pressure-sensitive adhesive layer 44 for affixing the disk to the drumhead. A peel-off backing layer 46 can be provided to cover the adhesive layer 44 when the disk is not in use. As mentioned above, the contact 14 is preferably adhered to the drumhead 18 somewhat near the hold-down hoop 16 and within the reach of the strap 12, 23 or 32. When damping of the drumhead 18 is desired, the contact attachment end 22 of the strap 12 or 23, or the contact attachment pad 36 of the strap 32, is connected to the contact 14, whereby the loop material of the strap engages the hook material of the disk contact. When damping is not desired, the drummer simply disengages the strap from the contact 14 by unhooking the hook material of the contact 14 from the loop material of the strap 12, 23 or 32.

Figure 7:
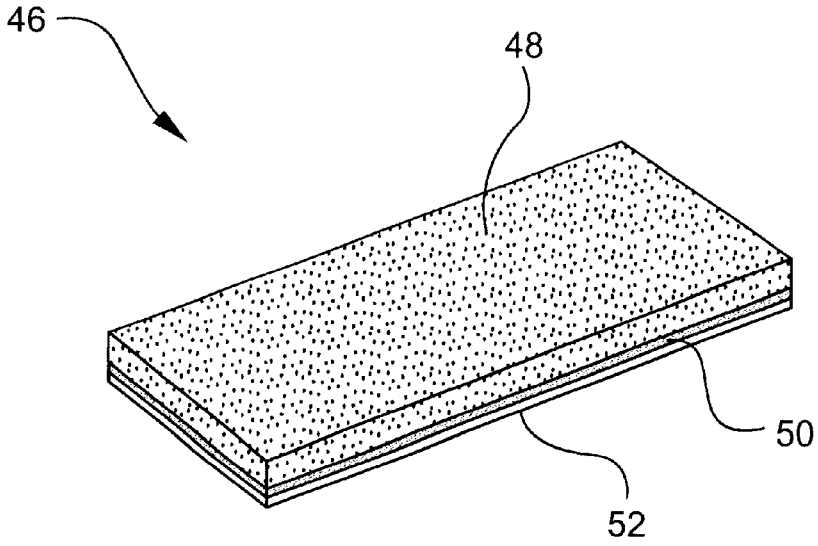
FIG. 7 is a perspective view of the adhesive hoop mounting pad of the damping devices of the present invention shown in FIGS. 1–5.

Attachment of the strap 12, 23 or 32 to the drumhead hold-down hoop 16 can also be accomplished using loop and hook fasteners. Preferably, the device 10 is supplied with a strap attachment pad 46, as shown in FIG. 7, for releasably securing the strap 12, 23 or 32 to the hold-down hoop 16. Similar to the drumhead disk 14, the strap attachment pad 46 preferably includes a thin Velcro™ hook material layer 48 and a pressure-sensitive adhesive layer 50 for affixing the pad to the drumhead hold-down hoop 16, preferably on the outer surface of the hold-down hoop. A peel-off backing layer 52 can also be provided to cover the adhesive layer 50 prior to use. The pad 46 is preferably rectangular in shape to fit on the relatively narrow outer rim of the hold-down hoop 16; however, any shape is envisioned as long as it can properly secure the strap to the hold-down hoop 16. The hoop attachment end 20 of the strap 12 or 23 or the hoop attachment pad 34 of the strap 32 is attached to strap attachment pad 46 by engaging the loop material of the strap with the hook material of the pad. Thus, the strap can be easily removed from the hoop as desired.

Figure 8:
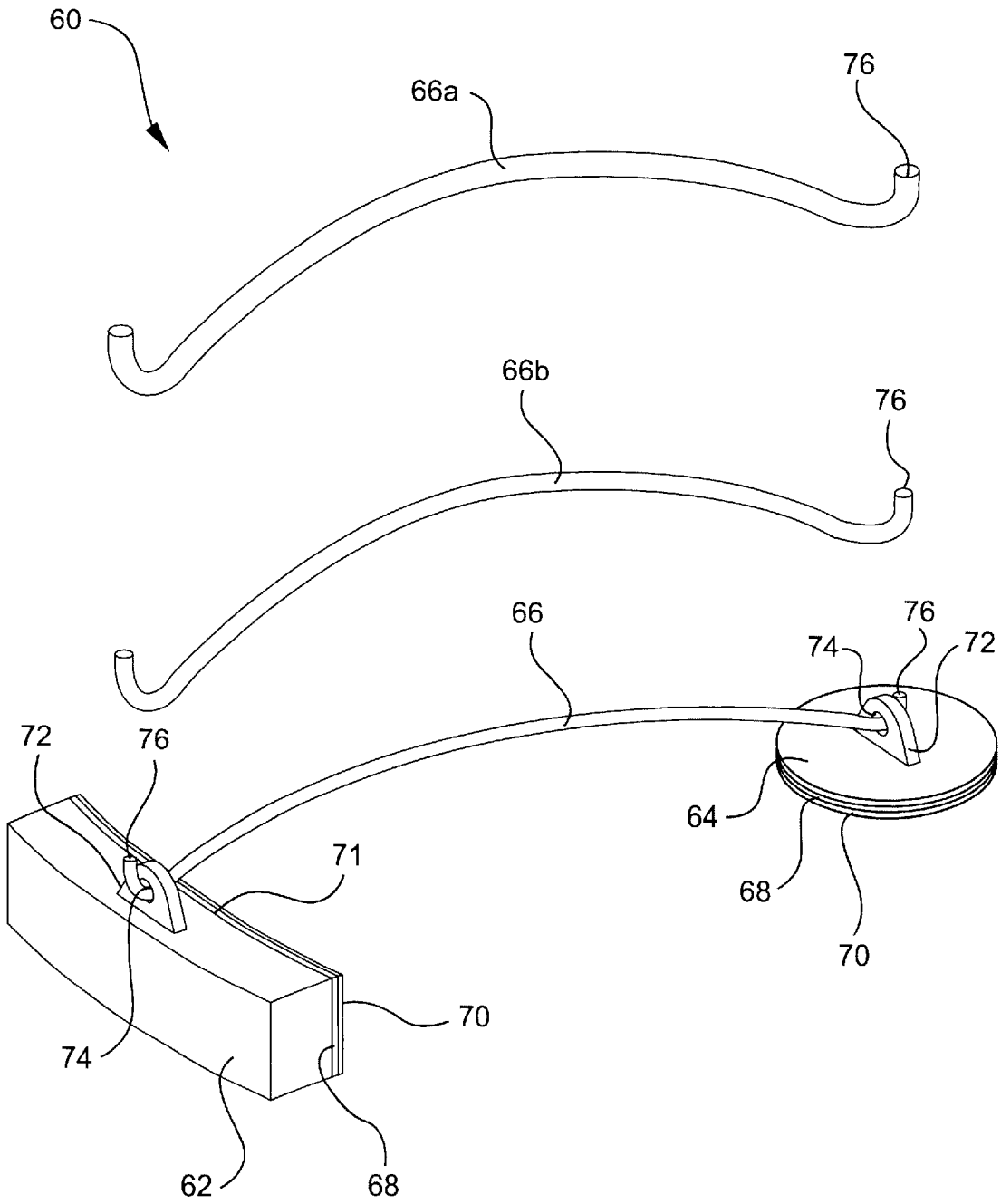
FIG. 8 is a top perspective view of a fourth embodiment of the damping device formed in accordance with the present invention.

Another alternative embodiment of the drum damping device, not using loop and hook attachment means, is shown in FIG. 8. The device 60 shown in FIG. 8 includes a hoop attachment fitting 62, a drumhead contact fitting 64, and a flexible wire 66 interconnecting the two fittings 62, 64. Again, the wire 66 can be any suitable material having some degree of stiffness, such as piano wire, wound music string, and spring steel, but also rubber and other "bridging" materials may be used for member 66. Additionally, the device 60 can be supplied with a plurality of different sized wires 66*a* and 66*b* to provide a variety of damping effects. The hoop attachment fitting 62 and the drumhead contact fitting 64 are preferably made from injection molded plastic and include a pressure-sensitive adhesive layer 68 on their respective mounting surfaces. A peel-off backing layer 70 can also be provided to cover the adhesive layer 68 prior to use. The hoop attachment fitting 62 preferably includes a curved mounting surface 71 to match the curvature of the drumhead hold-down hoop 16. The contact fitting 64 is preferably a thin, circular member similar to the disk contact 14 described previously. The fittings 62 and 64 are both molded to have an ear projection 72 extending from an exposed surface thereof and having a hole 74 for releasably connecting the wire 66 thereto. The wire 66 is connected to the hoop attachment fitting 62 and the contact fitting 64 by slipping the ends of the wire into the holes 74 of the projection ears 72. The wire 66 may include hooked ends 76 to better retain the wire to the fittings 62 and 64. When damping of the drumhead 18 is desired, the wire 66 is simply connected between the ear projections 72 of the fittings 62 and 64. When damping is not desired, the wire 66 is simply disconnected from one or both of the fittings 62 and 64, leaving the fittings in place. As mentioned above, the wire 66 can be interchanged with wires 66*a* and 66*b* when different damping effects are desired.

Similar to the device 10 described previously in relative to FIG. 2, the contact fitting 64 may be releasably (or semi-permanently) affixed to the drumhead 18 by its adhesive layer 68, while the hoop attachment fitting 62 may be releasably (or substantially permanently) affixed to the outer rim of the drumhead hold-down hoop 16 by its adhesive layer 68. That is, the fittings 62 and 64 are simply adhered to their respective surfaces using their pressure-sensitive adhesive layers 68, and may be removed and reattached by the drummer, as desired. Of course, the properties of the adhesive used in layers 68 must be such as to allow repeated attachment and removal of the fittings, if semi-permanent attachment is not desired. Alternatively, the contact fitting 64 and/or the hoop attachment fitting 62 can include exposed Velcro™ surfaces instead of adhesive layer 68 and protective layer 70 so that they may work in conjunction with and releasably engage the drumhead contact 14 and the hold-down hoop attachment pad 46 of the earlier-described embodiments.

The bridge damping device of the present invention provides a means of slowing down or inhibiting the vibration of the drumhead without adding excessive mass to the head surface. Specifically, the contact 14 and the contact fitting 64 are relatively small and lightweight, resulting in minimal impact on the natural vibration of the head. This method eliminates unwanted audio artifacts generally produced by other types of damping techniques (such as the Moon-Gel and Zero-Ring™ dampeners) and maximizes drumstick response by preserving the natural feel of the head.

Additionally, as shown by the different embodiments described above, the "bridge" material, shape and dimensions of the damping device can vary, depending on the desired damping effect and the size of the drum. Thus, this bridge method of damping can be applied to all drumhead types (e.g., tom-toms, snare drums, bass drums, marching drums, tympani, etc.). Moreover, the damping device itself can be adjusted by selecting shorter or longer straps or by adjusting the placement and size of the drumhead contact for further tone adjustment. For even further damping, more than one damping device of the present invention can be mounted, as desired, on the top or the bottom drumhead. It should be further understood that the components of the damping device made with either a hook fastener surface or a loop fastener surface may be made with the opposite fastener material and still achieve satisfactory results.

As a result of the present invention, a device is provided that affects the sound of any drumhead-type percussion instrument by shortening the sustain while imposing mild and balanced overtone suppression. Overtone suppression varies with the velocity of the drumstick striking the head. The present invention produces a focused, punchy, controlled drum sound while maximizing dynamic range of the percussion instrument. The device offers unlimited damping possibilities whereby the drum sound can be changed instantly without the need for tedious drumhead removal and replacement. At the same time, damping can be eliminated with the drummer's quick and a simple hand movement to disengage the damping devices from the drumhead.

Although illustrative embodiments of the present invention have been described herein with reference to the accompanying drawings, it is to be understood that the invention is not limited to those precise embodiments and that various other changes may be effected herein by one skilled in the art without departing from the scope or spirit of the invention.

What is claimed is:

1. A vibration damping device for a percussion instrument having a drumhead and an exposed surface, comprising:

a drumhead contact mounted on the drumhead of the percussion instrument; and an elongate member having a first end and a second end opposite the first end, the first end being adapted to be secured to the exposed surface of the percussion instrument and the second end being adapted to be releasably connected to the drumhead contact and thereby selectively forming a drum vibration bridge between the drumhead and the exposed surface of the percussion instrument.

2. A damping device as defined by claim 1, wherein the drumhead contact includes an adhesive layer for mounting the drumhead contact to the drumhead of the percussion instrument.

3. A damping device as defined by claim 1, wherein the elongate member includes means for releasably holding the second end of the elongate member in proximity to another portion of the elongate member when the second end of the elongate member is not engaging the drumhead contact.

4. A damping device as defined by claim 1, wherein the elongate member includes a material having one of a hook and loop fastening surface at the second end and wherein the drumhead contact includes the other of a hook and loop fastening surface, the fastening surface of the elongate member releasably engaging the fastening surface of the drumhead contact.

5. A damping device as defined by claim 4, wherein the elongate member further includes a patch attached thereto and having one of a hook and loop fastening surface, the fastening surface of the second end or the elongate member releasably engaging the fastening surface of the patch for releasably securing the second end of the elongate member to the patch when the second end of the elongate member is not engaging the drumhead contact.

6. A damping device as defined by claim 1, wherein the elongate member includes at least one neck portion defining the second end with a teardrop shape.

7. A damping device as defined by claim 1, further comprising an elongate member attachment pad having an adhesive layer for attaching the elongate member attachment pad to the exposed surface of the percussion instrument, the first end of the elongate member being releasably connected to the pad.

8. A damping device as defined by claim 7, wherein the elongate member includes a material having one of a hook and loop fastening surface at the first end, and wherein the elongate member attachment pad includes the other of a hook and loop fastening surface, the fastening surface of the first end of the elongate member releasably engaging the fastening surface of the elongate member attachment pad for providing releasable connection between the elongate member and the elongate member attachment pad.

9. A damping device as defined by claim 1, wherein the first end of the elongate member includes an instrument surface attachment foot; wherein the second end of the elongate member includes a drumhead contact attachment foot; and wherein the elongate member includes a wire connected to the instrument surface attachment foot and to the drumhead contact attachment foot.

10. A damping device as defined by claim 9, wherein the drumhead contact attachment foot includes a material having one of a hook and loop fastening surface, and wherein the drumhead contact includes the other of a hook and loop fastening surface, the fastening surface of the drumhead contact attachment foot releasably engaging the fastening surface of the drumhead contact for providing a releasable connection between the drumhead contact and the elongate member.

11. A damping device as defined by claim 9, further comprising an elongate member attachment pad having an adhesive layer for attaching the elongate member attachment pad to the exposed surface of the percussion instrument, the instrument surface attachment foot of the elongate member being releasably connected to the pad.

12. A damping device as defined by claim 11, wherein the instrument surface attachment foot including a material having one of a hook and loop fastening surface, and wherein the elongate member attachment pad includes the other of a hook and loop fastening surface, the fastening surface of the instrument surface attachment foot releasably engaging the fastening surface of the elongate member attachment pad for providing a releasable connection between the elongate member and the elongate member attachment pad.

13. A damping device as defined by claim 9, wherein the drumhead contact attachment foot includes a plastic fitting having an ear projection formed thereon and defining a hole, the wire being received by the hole and thereby being connected to the fitting of the drumhead contact attachment foot.

14. A damping device as defined by claim 13, wherein the wire is removably received by the fitting hole of the drumhead contact attachment foot.

15. A damping device as defined by claim 9, wherein the instrument surface attachment foot includes a plastic fitting having an ear projection formed thereon and defining a hole, the wire being received by the hole and thereby being connected to the fitting of the instrument surface attachment foot.

16. A damping device as defined by claim 15, wherein the wire is removably received by the fitting hole of the instrument surface attachment foot.

17. A damping device as defined by claim 15, wherein the instrument surface attachment foot includes a curved mounting surface and an adhesive layer disposed on the mounting surface for securing the instrument surface attachment foot to the exposed surface of the percussion instrument.

* * * * *